US005183435A

United States Patent [19]

Galvez

[11] Patent Number: 5,183,435

[45] Date of Patent: Feb. 2, 1993

[54] SEASONAL ATTIC TURBINE VENTILATOR

[76] Inventor: Bennie R. Galvez, 4604 Lindale Dr., Wichita Falls, Tex. 76310

[21] Appl. No.: 820,195

[22] Filed: Jan. 13, 1992

[51] Int. Cl.[5] ..... F24F 7/02

[52] U.S. Cl. ..... 454/18; 454/30

[58] Field of Search ..... 454/15, 18, 19, 28, 454/30

[56] References Cited

U.S. PATENT DOCUMENTS

| | | | |
|---|---|---|---|
| 1,133,969 | 3/1915 | Johnston | 454/19 |
| 2,923,225 | 2/1960 | Massey . | |
| 3,952,638 | 4/1976 | Felter et al. | 454/18 X |
| 4,047,682 | 9/1977 | Brownhill | 244/110 B |
| 4,231,288 | 11/1980 | Finley | 454/18 X |
| 4,924,760 | 5/1990 | Jobson . | |
| 4,962,783 | 10/1990 | Ball et al. | 137/1 |
| 4,964,431 | 10/1990 | Ball et al. | 137/1 |
| 4,967,997 | 11/1990 | Hines et al. | 251/56 |
| 4,969,485 | 11/1990 | Ball et al. | 137/599 |

*Primary Examiner*—Harold Joyce

*Attorney, Agent, or Firm*—Norman B. Rainer

[57] ABSTRACT

An improvement is provided in a roof-mounted turbine-type ventilation fan and associated air-handling duct whereby rotation of the fan is stopped and the duct is closed during periods of cold weather. Stoppage of rotation of the fan is achieved by an elongated locking pin that penetrates aligned apertures in an annular lower rim of the fan and in a bearing collar located atop the duct and normally slidably interactive with the annular lower rim. Closure of the duct is achieved by a circular butterfly damper panel positioned within the duct.

3 Claims, 1 Drawing Sheet

SEASONAL ATTIC TURBINE VENTILATOR

BACKGROUND OF THE INVENTION

1. Field of the Invention

This invention relates to attic ventilation fans, and more particularly concerns a turbine-type attic fan adapted to be secured from rotation and sealed from air passage during periods of cold weather.

2. Description of the Prior Art

Numerous attic ventilation devices have been disclosed in the prior art. Such devices typically are employed to exhaust hot air from the attic of a house or industrial structure during hot summer months. There are many varieties of attic ventilators. Some passive types of units are as simple as louvers or other vent means which merely allows the escape of heated air. Other units are thermostatically controlled and have electric fans or blowers designed to expel a greater airflow. These units often use as much energy as is saved by cooling the attic. Yet other ventilators utilize a rotating turbine fan which derives its rotational force from the wind acting upon a radial array of fan blades. Even a slight breeze is sufficient to create the required rotation for energy efficient attic cooling.

Various methods have been employed in attempts to selectively disable and enable such devices. For example, U.S. Pat. No. 4,924,760, to Jobson, discloses an attic ventilator fan having a vent damper device which is automatically closed in the event of a fire. A fusible link is employed to maintain the damper in an opened position until a predetermined threshold temperature is achieved. Once the elevated temperature created by a fire melts the fusible link, a spring pulls the damper to a closed position. Since the fusible link is a single use component, this damper is not easily opened and closed to allow for seasonal temperature changes.

Various other types of roof vent dampers have been disclosed in the prior art. A typical example of such roof vent damper is to be found in U.S. Pat. 2,183,645, issued to R. Hansen, which discloses a roof vent having a pivotal damper plate operable from a remote location through a rope and pulley mechanism. U.S. Pat. 2,218,926 to Telchmann concerns a damper system for an industrial building roof, and utilizes a pair of pivotal opposed dampers, U.S. Pat. 2,285,829 to A. Maage, Jr. discloses a damper regulator for a rectangular cross section ventilation duct, and is formed as a pivotally mounted rectangular plate. U.S. Pat. 2,923,225, issued to C. Massey discloses a roof ventilator having a pivotal damper plate which is biased to an open position by a counter weight and is manually closeable by a rope. U.S. Pat. 4,759,270, issued to Lindeen, discloses a vent cap cover for a recreational vehicle vent including a pivotal damper.

Although the aforementioned devices incorporate damping means for roof mounted ventilators, they are not specific to the turbine fan type ventilator. For example, the Massey damper is specifically applicable to a ventilator having an elongated rectangular cross section. The Jobson damper is not designed for interactive usage within a ventilator duct, and is mounted in a manner to occlude the roof aperture at the lower extremity of the duct. Such device is generically applicable to any ventilation duct or orifice.

Furthermore, the aforementioned devices are designed to block the majority of airflow through the vent by means of a damper device. However, due to the imperfect nature of the damper, a decreased airflow may still pass as a downdraft or convection current. A specific problem related to the turbine roof ventilator is that, although the airflow may be damped to some degree, the turbine unit continues to rotate with any significant breeze, thereby creating a draft across the damper device. A generally accepted practice has been to cover the turbine unit with a plastic sheet or other cover device. The wrapping of the fan serves several purposes. The draft is eliminated. Wear and tear caused by the normal turning of the fan is arrested during the period of non-usage, thereby lengthening the life of the fan. Moreover, potential damage to the fan blades by turning while encrusted with snow and ice is averted. However, the plastic or other wrapping material often will not withstand the wind, cold, and ultraviolet radiation of the sun. The cover usually tears free at times when inclement weather precludes climbing upon a rooftop to facilitate repair.

It is therefore an object of the present invention to provide a modified turbine fan attic ventilator device adapted to be secured from rotation during periods of non-use.

It is another object of the present invention to provide a device of the aforesaid nature which has damper means which may be closed during periods of non-use in order to prevent passage of draft currents.

It is a further object of this invention to provide a device of the aforesaid nature which is simple to operate, durable, and amenable to low cost manufacture.

These objects and other objects and advantages of the invention will be apparent from the following description.

SUMMARY OF THE INVENTION

The above and other beneficial objects and advantages are accomplished in accordance with the present invention by an improvement in a rooftop mounted turbine fan attic ventilator comprised of:

a) a duct having a circular cylindrical sidewall oriented upon a vertical axis, a flanged lower extremity fixedly associated with an underlying roof, an interior region bounded in part by said sidewall, and an upper extremity having a horizontally oriented bearing collar, b) a substantially spherical turbine fan having a circular upper support panel and an annular lower rim which defines a circular aperture, and a multiplicity of vertically oriented fins, each fin having an upper extremity fixedly associated with said upper panel and a lower extremity fixedly associated with said annular rim, each fin having a leading edge and trailing edge and a cupped configuration which disposes said leading edge outwardly from said trailing edge, said turbine fan being mounted upon said duct in overlying juxtaposition wherein said annular rim is concentrically disposed about said bearing collar in close juxtaposition therewith, said improvement comprising:

a) diametrically opposed locking apertures in said annular rim and diametrically opposed locking bores in said bearing collar, said apertures and bores adapted to be linearly aligned by means of rotative orientation of said fan relative to said duct, b) an elongated locking pin adapted to be inserted through said aligned locking apertures and bores, thereby securing said fan from rotation relative to said duct, and c) butterfly valve damper means comprised of:

1) diametrically opposed holes in said cylindrical wall, 2) a elongated shaft having a proximal extremity penetrating one of said holes and having lever rotating means, and a distal extremity penetrating said opposed hole, 3) a circular damper panel having a bisecting centerline fixedly associated with said shaft upon said centerline and adapted to rotate within said interior region in close conformity with said cylindrical wall, and 4) helical spring means acting between said distal extremity and said sidewall, thereby maintaining said panel in either vertical or horizontal orientation responsive to adjustment force applied to said lever.

In a preferred embodiment the lever means may be in the form of a bi-metallic coil adapted to open and close said damper according to predetermined temperature levels. In other embodiments, the lever may be in the form of a handle which may be manually turned. In yet other embodiments, the damper may be controlled by a thermally controlled override mechanism adapted to close the damper in the event of a fire.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
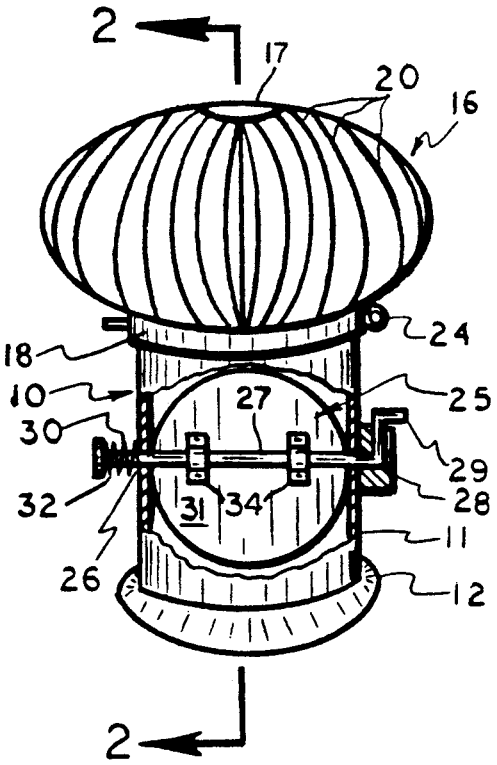
FIG. 1 is a side perspective view, with portions broken away, illustrating an embodiment of the modified attic turbine ventilator of the present invention.
Figure 4:
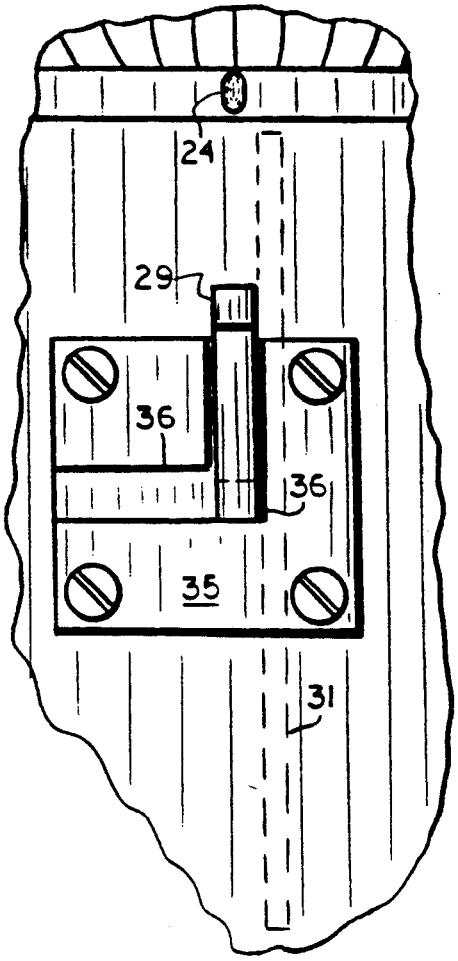
FIG. 4 is an enlarged fragmentary view of the right side of FIG. 1.
Figure 2:
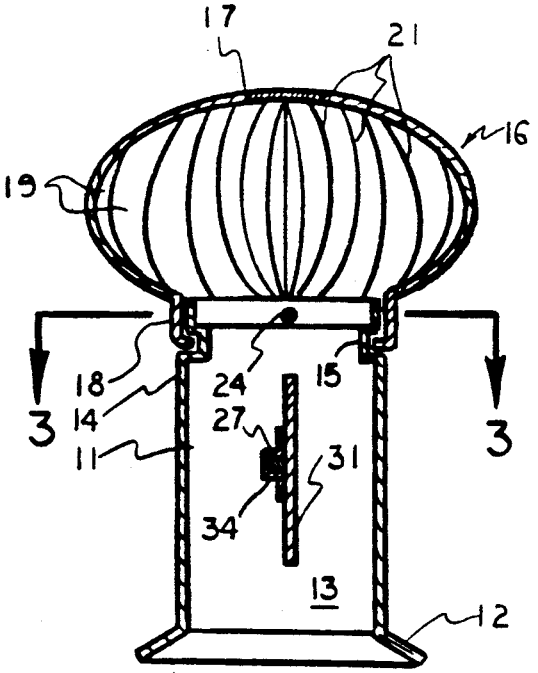
FIG. 2 is a vertical sectional view taken in the direction of the arrows along line 2—2 of FIG. 1.
Figure 3:
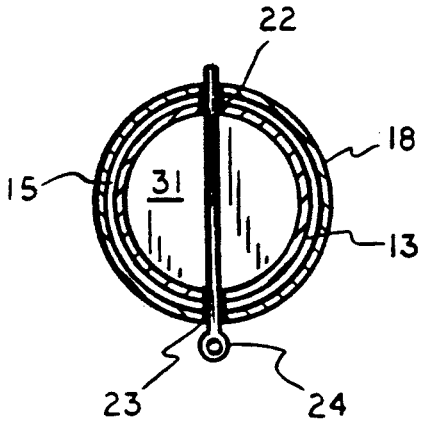
FIG. 3 is a horizontal sectional view taken in the direction of the arrows along line 3—3 of FIG.2, and showing the damper panel in its closed position.

Referring to FIGS. 1–4, an embodiment of a rooftop mounted turbine fan attic ventilator is shown comprised of vertically oriented duct 10 having a circular cylindrical sidewall 11, a flanged lower extremity 12 adapted to be fixedly associated with an underlying roof, an interior region 13 bounded in part by said sidewall, and an upper extremity 14 having a horizontally oriented circular bearing collar 15 that rotatively supports a substantially spherical turbine fan 16.

Said fan is comprised of circular upper support panel 17, and circular lower rim 18 which defines a circular aperture relative to duct 10. A multiplicity of uniformly spaced vertically oriented fins 19 are attached at their upper extremities to panel 17, and attached at their lower extremities to rim 18. Each fin has a leading edge 20 and a trailing edge 21, and is cupped so as to dispose the leading edge radially outwardly with respect to the trailing edge. Annular rim 18 slidably engages bearing collar 15, thereby permitting rotative movement of the fan about the duct. Rotation of the fan may be accomplished either by ambient wind currents, or by a motor mechanism of conventional construction.

The improvement of the present invention comprises the placement of diametrically opposed and vertically aligned locking apertures 22 and bores 23 in said collar 15 and rim 18, respectively, and an elongated locking pin 24 adapted to be inserted through said aligned locking apertures and bores, thereby securing said fan from rotation. Butterfly valve damper means 25 is comprised of diametrically opposed holes 26 in said cylindrical wall, an elongated shaft 27 having a proximal extremity 28 penetrating one of said holes, a lever rotating arm 29, and a distal extremity 30 penetrating said opposed hole. A circular damper panel 31 is secured by bracket clamps 34 or equivalent means to said shaft upon a diameter of panel 31, whereby said panel is adapted to rotate within interior region 13 in close conformity with said cylindrical wall. A helical spring 32 is disposed upon shaft 27 adjacent distal extremity 30 and adapted to exert force upon said sidewall, thereby maintaining damper panel 31 in either vertical or horizontal orientation in response to adjustment force applied to rotating arm 29. Holding means in the form of block 35 having recessed grooves 36, is disposed upon the exterior of sidewall 11. Said grooves accommodate handle 29 which secured within the grooves by the action of spring 32.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. In a rooftop-mounted turbine fan attic ventilator comprised of:

a) a duct having a circular cylindrical sidewall centered upon a vertical axis, a flanged lower extremity adapted to lie flush against an underlying roof, an interior region bounded in part by said sidewall, and an upper extremity having a horizontally oriented bearing collar, and b) a turbine fan having an annular lower rim and a multiplicity of vertically oriented fins, said turbine fan being mounted upon said duct in overlying juxtaposition wherein said annular rim is concentrically disposed with respect to said bearing collar in close juxtaposition therewith, the improvement comprising:

a) diametrically opposed locking apertures in said annular rim and diametrically opposed locking bores in said bearing collar, said apertures and bores adapted to be linearly aligned by means of rotative orientation of said fan relative to said duct, b) an elongated locking pin adapted to be inserted through said aligned locking apertures and bores, thereby securing said fan from rotation relative to said duct, and c) butterfly valve damper means comprised of:

1) diametrically opposed holes in said cylindrical wall, 2) a elongated shaft having a proximal extremity that penetrates one of said holes and having lever rotating means, and a distal extremity that penetrates said opposed hole, 3) a circular damper panel attached to said shaft along the diameter of said damper panel, thereby enabling said damper panel to rotate within said interior region in close conformity with said cylindrical wall, and 4) spring means acting between said distal extremity and said sidewall, thereby maintaining said damper panel in either vertical or horizontal orientation responsive to adjustment force applied to said lever rotating means, said vertical and horizontal orientations corresponding to open and closed conditions, respectively, of said duct.

2. The improvement of claim 1 wherein holding means are provided to secure said damper panel in either vertical or horizontal orientation.

3. The improvement of claim 2 wherein said lever rotating means is provided with a bi-metallic coil adapted to automatically rotate said damper panel between vertical and horizontal orientations in response to ambient air temperature surrounding the turbine fan.

* * * * *